US009915491B2

(12) United States Patent
Perry

(10) Patent No.: US 9,915,491 B2
(45) Date of Patent: Mar. 13, 2018

(54) MAGNETIC TRIGGER ASSEMBLY WITH REDUCED TRAVEL AND METHOD

(71) Applicant: Barnett Outdoors, LLC, Tarpon Springs, FL (US)

(72) Inventor: Dale Perry, Goodyear, AZ (US)

(73) Assignee: Barnett Outdoors, LLC, Tarpon Springs, FL (US)

( * ) Notice: Subject to any disclaimer, the term of this patent is extended or adjusted under 35 U.S.C. 154(b) by 0 days.

(21) Appl. No.: 15/649,719

(22) Filed: Jul. 14, 2017

(65) Prior Publication Data

US 2018/0017349 A1 Jan. 18, 2018

Related U.S. Application Data

(60) Provisional application No. 62/363,013, filed on Jul. 15, 2016.

(51) Int. Cl.

| | |
|---|---|
| ***F41B 5/18*** | (2006.01) |
| ***F41A 19/10*** | (2006.01) |
| ***H01F 7/02*** | (2006.01) |
| ***F41A 19/12*** | (2006.01) |
| ***F41A 19/59*** | (2006.01) |
| ***F41A 17/28*** | (2006.01) |
| ***F41A 17/46*** | (2006.01) |
| ***F41A 17/56*** | (2006.01) |
| *F41B 5/14* | (2006.01) |

(52) U.S. Cl.

CPC ..... *F41A 19/10* (2013.01); *F41A 17/28* (2013.01); *F41A 17/46* (2013.01); *F41A 17/56* (2013.01); *F41A 19/12* (2013.01); *F41A 19/59* (2013.01); *H01F 7/0242* (2013.01); *F41B 5/1469* (2013.01); *F41B 5/1484* (2013.01)

(58) Field of Classification Search

CPC ..... F41B 5/12; F41B 5/1469

See application file for complete search history.

(56) References Cited

U.S. PATENT DOCUMENTS

| | | | | |
|---|---|---|---|---|
| 6,802,304 | B1 | 10/2004 | Chang | |
| 6,802,305 | B1 * | 10/2004 | Hatcher | F41A 19/10 124/31 |
| 9,506,715 | B2 | 11/2016 | Hughes | |
| 2006/0042612 | A1 | 3/2006 | Stanislawski | |

* cited by examiner

*Primary Examiner* — John Ricci

(74) *Attorney, Agent, or Firm* — Jones Walker LLP

(57) ABSTRACT

A trigger assembly includes one or more stationary magnets and a trigger member pivotable relative to the stationary magnets. The trigger member includes a base portion with a pivot point, an actuating portion extending from the base portion in a first direction, and a magnetic trigger portion extending from the base portion in a second direction. The magnetic trigger portion operatively engages the stationary magnets in a first position. The base portion of the trigger member operatively engages a first sear element, which is operatively connected to a sear arm, which in turn operatively engages a second sear element. A spring operatively biases the first sear element. The second sear element retains a bow string in the first position. In a second position, the trigger member rotates to separate the magnetic trigger portion from the magnets, and the second sear element rotates to release the bow string.

20 Claims, 10 Drawing Sheets

MAGNETIC TRIGGER ASSEMBLY WITH REDUCED TRAVEL AND METHOD

CROSS REFERENCE TO RELATED APPLICATION

This application claims the benefit of and priority to U.S. Provisional Patent Application No. 62/363,013, filed Jul. 15, 2016, which is incorporated herein by reference in its entirety.

SUMMARY OF THE INVENTION

A trigger assembly includes one or more stationary magnets and a trigger member a trigger member pivotable relative to the stationary magnets. The trigger member includes a base portion with a trigger pivot point about which the trigger member pivots, an actuating portion extending from the base portion in a first direction, and a magnetic trigger portion extending from the base portion in a second direction. The magnetic trigger portion operatively engages the one or more stationary magnets in a first position. The trigger assembly also includes a first sear element, a spring operatively biasing the first sear element, a sear arm operatively connected to the first sear element, and a second sear element operatively connected to the first sear element. The first sear element is pivotable about a first sear pivot point. The base portion of the trigger member operatively engages the first sear element. The second sear element includes a proximal portion, a distal portion, and a second sear pivot point between the proximal portion and the distal portion. The proximal portion operatively engages the sear arm, and the second sear element is pivotable about the second sear pivot point to retain a bow string in the first position. In a second position, the magnetic trigger portion is spaced apart from the one or more stationary magnets and the distal portion of the second sear element releases the bow string.

The distal portion of the second sear element may include a hook shape. The trigger assembly may further include a housing. The trigger member, the first sear element, and the second sear element may each be pivotally mounted to the housing. The actuating portion of the trigger member and the second sear element may each extend beyond the housing.

In one embodiment, the spring biases the first sear element toward the first position. The trigger assembly may further include a second trigger member connected to the base portion of the trigger member and engaging the first sear element. The trigger assembly may further include an alignment pen disposed through a longitudinal groove in the second trigger member. The trigger assembly may further include a stationary finger rest extending from the housing opposite the actuating portion of the trigger member.

In another embodiment, the spring biases the first sear element toward the second position. In the first position, a distal end of the sear arm may engage the proximal portion of the second sear element to maintain the second sear element in the first position. In the second position, the distal end of the sear arm may disengage from the proximal portion of the second sear element to allow the second sear element to rotate about the second sear pivot point into the second position releasing the bow string. A proximal end of the sear arm may include a key portion. The first sear element may further include a receptacle and a receptacle spring disposed within the receptacle. The key portion of the sear arm may be disposed within the receptacle and may be biased by the receptacle spring.

The trigger assembly may further include a safety assembly operatively engaging the first sear element. In the first position, the safety assembly may engage the first sear element to prevent the first sear element from rotating about the first sear pivot point into the second position. In a safety-released position, the safety assembly may disengage the first sear element to allow the first sear element to rotate about the first sear pivot point if the trigger member disengages the first sear element.

The safety assembly may include a safety trigger, a spring, and a safety lock. The safety trigger may be slidingly mounted to the housing. The safety trigger may include a safety surface and a spring portion. The spring may engage the spring portion to bias the safety trigger toward the first position. The safety lock may be pivotable about a safety pivot point. A first end of the safety lock may engage the spring portion of the safety trigger. A lock portion of the safety lock may engage the first sear element. In the first position, the lock portion of the safety lock may prevent the first sear element from rotating about the first sear pivot point. Actuation of the safety trigger may rotate the safety lock about the safety pivot point to disengage the lock portion from the first sear element in the safety-released position.

The one or more stationary magnets may be separated from the trigger pivot point by a distance of at least ½ inch. Alternatively, the one or more stationary magnets may be separated from the trigger pivot point by a distance of at least ¾ inch.

A method of releasing a bow string to fire a weapon may include the steps of: (a) providing a trigger assembly including: one or more stationary magnets; a trigger member pivotable relative to the stationary magnets, wherein the trigger member includes a base portion with a trigger pivot point about which the trigger member pivots, an actuating portion extending from the base portion in a first direction, and a magnetic trigger portion extending from the base portion in a second direction, wherein the magnetic trigger portion operatively engages the one or more stationary magnets in a first position; a first sear element pivotable about a first sear pivot point, wherein the base portion of the trigger member operatively engages the first sear element; a spring operatively biasing the first sear element; a sear arm operatively connected to the first sear element; a second sear element including a proximal portion, a distal portion, and a second sear pivot point between the proximal portion and the distal portion, wherein the proximal portion operatively engages the sear arm, and wherein the second sear element is pivotable about the second sear pivot point to retain a bow string in the first position; wherein in a second position the magnetic trigger portion is spaced apart from the one or more stationary magnets and the distal portion of the second sear element releases the bow string; (b) engaging a bow string of a weapon with the distal portion of the second sear element with the trigger assembly in the first position; (c) cocking the weapon with the bow string secured with the second sear element of the trigger assembly; and (d) applying a force to the actuating portion of the trigger member to rotate the trigger member into the second position and rotate the second sear element into the second position, thereby releasing the bow string; wherein the trigger member and the second sear element do not rotate into the second position unless and until the force applied to the actuating portion of the trigger member meets or exceeds a threshold force value.

The threshold force value may be a force required to overcome a magnetic attraction between the magnetic trigger portion and the one or more stationary magnets. The threshold force value may be at least 1 pound.

The trigger assembly may further include a second trigger member connected to the base portion of the trigger member and engaging the first sear element. In step (d), the trigger member may rotate about the trigger pivot point to force the second trigger member to rotate the first sear element about the first sear pivot point, thereby rotating the second sear element to release the bow string.

The trigger assembly may further include a safety assembly operatively engaging the first sear element. In step (b), the safety assembly may engage the first sear element in the first position to prevent the first sear element from rotating about the first sear pivot point. The safety assembly may include a safety trigger and a safety lock. The safety lock may engage the first sear element in the first position. The method may further include the step of (c1) actuating the safety trigger to release the safety lock from the first sear element.

DETAILED DESCRIPTION OF THE PREFERRED EMBODIMENTS

Figure 2:
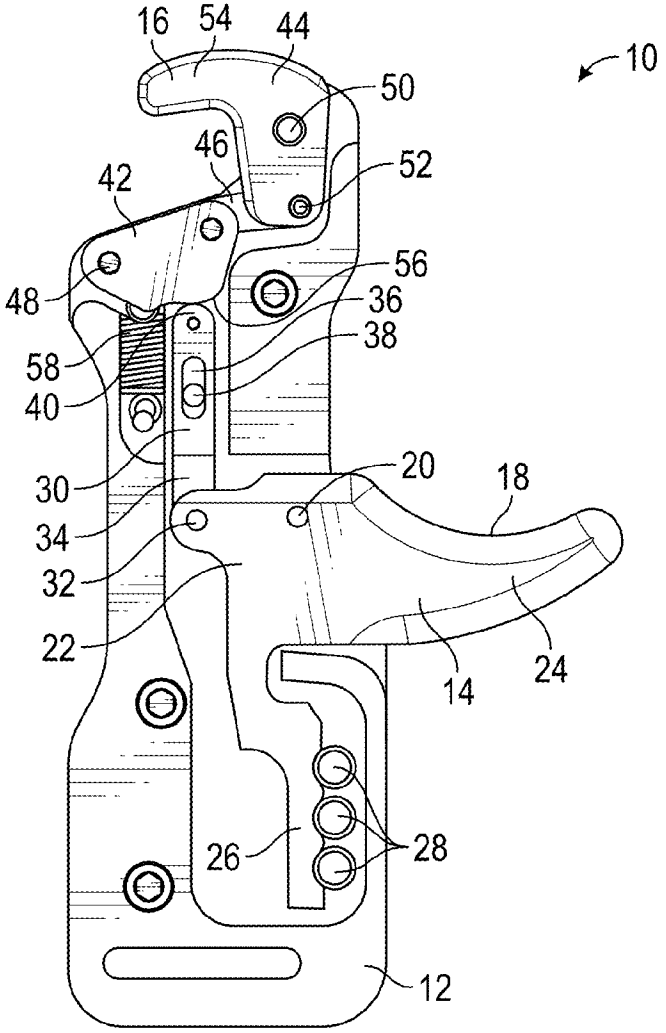
FIG. 2 is a cut-away view of the magnetic trigger assembly in a first position.

Triggers are used in shooting weapons, such as vertical bows, crossbows, and guns. The trigger may be located on or in the shooting weapon, such as in traditional crossbows and guns, or it may be located on a glove or other trigger mechanism or release aid used to release the string of certain bows, such as a vertical bow. Generally, a trigger assembly contains a sear that retains the hammer of a gun or the string of a bow until a force applied to the trigger reaches a threshold value, which releases the sear and fires the weapon. Trigger travel is the movement of the trigger caused by the application of force before the sear is released to fire the weapon. Many users struggle with the feeling of trigger travel, which may cause anticipation of firing the weapon or target panic, each of which results in poor shooting technique and lower accuracy.

Many conventional trigger assemblies include springs. When a user applies a force to the trigger, the movement of the trigger compresses the spring until the applied force exceeds that required to release a sear, which either directly or indirectly results in the firing of the weapon.

A trigger assembly described herein has a reduced amount of trigger travel before the applied force reaches the threshold value required to release the sear and fire the weapon. In one embodiment of the trigger assembly, there is no perceived trigger travel before the threshold force is reached.

The trigger assembly includes one or more stationary magnets and a trigger member pivotally attached within a housing. The trigger member includes a magnetic trigger portion, which engages the stationary magnets when the trigger assembly is in a first position. In one embodiment, the magnets are separated from a trigger pivot point of the trigger member by a distance of at least ½ inch. In other embodiments, the magnets are separated from the trigger pivot point by a distance of at least ¾ inch.

An actuating surface of the trigger member is configured to receive an applied force from a user. When the applied force meets or exceeds a threshold value, the trigger assembly is actuated from a first position to a second position in which the trigger assembly fires an associated weapon. For example, the trigger assembly may be included in a trigger release for use with a vertical bow. Alternatively, the trigger assembly may be incorporated into a crossbow or a gun.

As a user applies a force to the actuating surface of the trigger member with the trigger assembly in the first position, the magnetic trigger portion of the trigger member remains in contact with the stationary magnets, preventing movement of the trigger member until the applied force reaches the threshold value. When the threshold value is reached, the applied force overcomes the magnetic attraction between the magnet and the magnetic trigger portion, and the magnetic trigger portion separates from the magnets to actuate the trigger assembly into the second position. This actuation includes the trigger member pivoting about the trigger pivot point to a degree sufficient to cause a sear element of the trigger assembly to rotate about its pivot point to fire the weapon.

In this way, the trigger assembly provides reduced trigger travel (i.e., the trigger member does not move until the user applies a force sufficient to fire the weapon and/or a user does not perceive any trigger movement until the user applies enough force to fire the weapon). The magnet of the trigger assembly provides a crisp breaking point based on the strength of the magnets.

If the magnets are positioned too near the trigger pivot point, the magnets may be slowly pried apart due to leverage created with the trigger and the pivot point, thereby resulting in trigger movement before releasing the sear. In one embodiment, the magnets are positioned at least ½ inch from the trigger pivot point. In another embodiment, the magnets are positioned at least ¾ inch from the trigger pivot point.

FIGS. 1-14 illustrate embodiments of the trigger assembly that are configured for use with a vertical bow. The same reference numerals are used for similar components in the various embodiments. These trigger assembly arrangements may be employed in a crossbow trigger or a gun trigger as readily understood by a skilled artisan.

Figure 1:
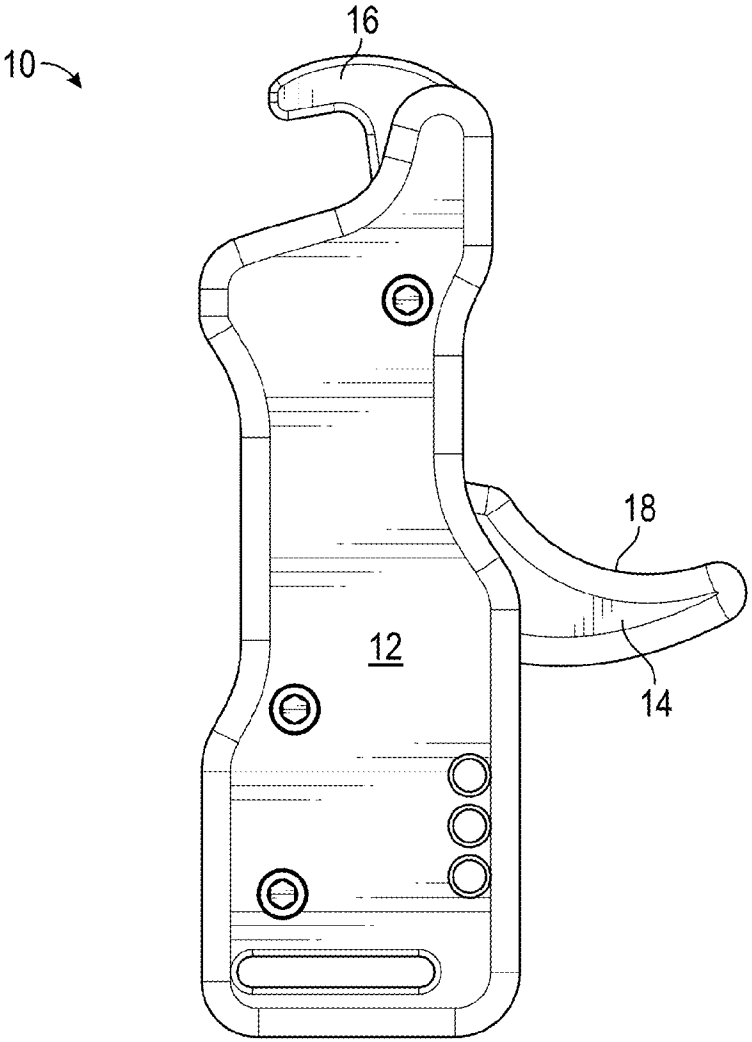
FIG. 1 is a side view of a magnetic trigger assembly.

With reference to FIG. 1, trigger assembly 10 includes housing 12 with a portion of trigger member 14 and hook portion 16 each extending beyond housing 12. Trigger member 14 includes actuating surface 18 configured to receive an applied force from a user (e.g., from the user's index finger or thumb). Hook portion 16 is configured to retain a bow string in a first position as shown in FIG. 1. Actuation of trigger member 14 places hook portion 16 in a second position, which releases the bow string.

Referring now to FIG. 2, trigger member 14 is mounted within housing 12 for pivotal movement about pivot point 20 on base portion 22 of trigger member 14. In one embodiment, pivot point 20 is formed by a trigger aperture in trigger member 14 and a pin disposed through the trigger aperture, with the pin engaging housing 12 to pivotally mount trigger member 14 therein. Trigger member 14 includes actuating portion 24 extending from base portion 22 in a first direction, and magnetic trigger portion 26 extending from base portion 22 in a second direction. Actuating portion 24 includes actuating surface 18. Trigger assembly 10 further includes one or more magnets 28 affixed within housing 12. Magnetic trigger portion 26 is adjacent to magnets 28.

As used herein, "first direction" and "second direction" are not the same direction. Trigger member 14 is configured to provide an angle between the first direction and the second direction of at least 35 degrees (i.e., the first and second directions are separated by at least 35 degrees). In some embodiments, the angle between the first direction and the second direction is between 35 and 180 degrees, or any subrange therein.

In the embodiment illustrated in FIG. 2, trigger assembly 10 further includes second trigger member 30 operatively connected to trigger member 14. For example, pin 32 may be disposed through an aperture in proximal end 34 of second trigger member 30 and an aperture in base portion 22 of trigger member 14. Second trigger member 30 may include longitudinal groove 36 within which alignment pin 38 is disposed for alignment of second trigger member 30 within housing 12. Second trigger member 30 may further include distal contact surface 40.

Referring still to FIG. 2, trigger assembly 10 further includes first sear element 42 and second sear element 44 interconnected by sear arm 46. First sear element 42 is mounted within housing 12 for pivotal movement about pivot point 48. In one embodiment, pivot point 48 is formed by an aperture through first sear element 42 and a pin disposed through the aperture, with the pin engaging housing 12 to pivotally mount first sear element 42 therein. Similarly, second sear element 44 is mounted at least partially within housing 12 for pivotal movement about pivot point 50. In one embodiment, pivot point 50 is formed by an aperture through second sear element 44 and a pin disposed through the aperture, with the pin engaging housing 12 to pivotally mount first sear element 44 therein. Sear arm 46 may be operatively connected to an end of first sear element 42 and to proximal end 52 of second sear element 44. For example, a first pin may be disposed through an aperture in the end of first sear element 42 and an aperture in a first end of sear arm 46, while a second pin is disposed through proximal end 52 of second sear element 44 and a second end of sear arm 46. Distal end 54 of second sear element 44 may include hook portion 16, which is configured to retain a bow string in the first position shown in FIG. 2. First sear element 42 may also include sear surface 56, which may be formed of a flat surface, a curved surface, a recess, a groove, or a notch configured to engage distal contact surface 40 of second trigger member 30.

Trigger assembly 10 may further include spring 58 mounted within housing 12 to bias first sear element 42. In the embodiment illustrated in FIG. 2, spring 58 may be a tension spring configured to bias first sear element 42 toward the first position illustrated in FIG. 2. In effect, spring 58 may bias first sear element 42 toward distal contact surface 40 of second trigger member 30.

In the first position as illustrated in FIG. 2, magnetic trigger portion 26 is in contact with magnets 28, and distal contact surface 40 of second trigger member 30 engages sear surface 56 of first sear element 42. Alternatively, magnetic trigger portion 26 may indirectly engage magnets 28, such as through a coating or other barrier allowing the sufficient magnetic attraction between magnets 28 and magnetic trigger portion 26 to allow trigger assembly 10 to function as described herein. In the first position, trigger member 14 is prevented from rotating due to the magnetic attraction between magnets 28 and magnetic trigger portion 26. Also in the first position, first and second sear elements 42 and 44 are prevented from rotating (and thereby prevented from releasing any bow string engaged by second sear element 44) by the tension of spring 58 applied to first sear element 42. When a force applied to actuating surface 18 of trigger member 14 reaches the threshold value required to overcome the magnetic attraction and the tension of spring 58, magnetic trigger portion 26 is released from magnets 28, thereby allowing trigger member 14 to rotate about pivot point 20 into the second position illustrated in FIG. 3.

Figure 3:
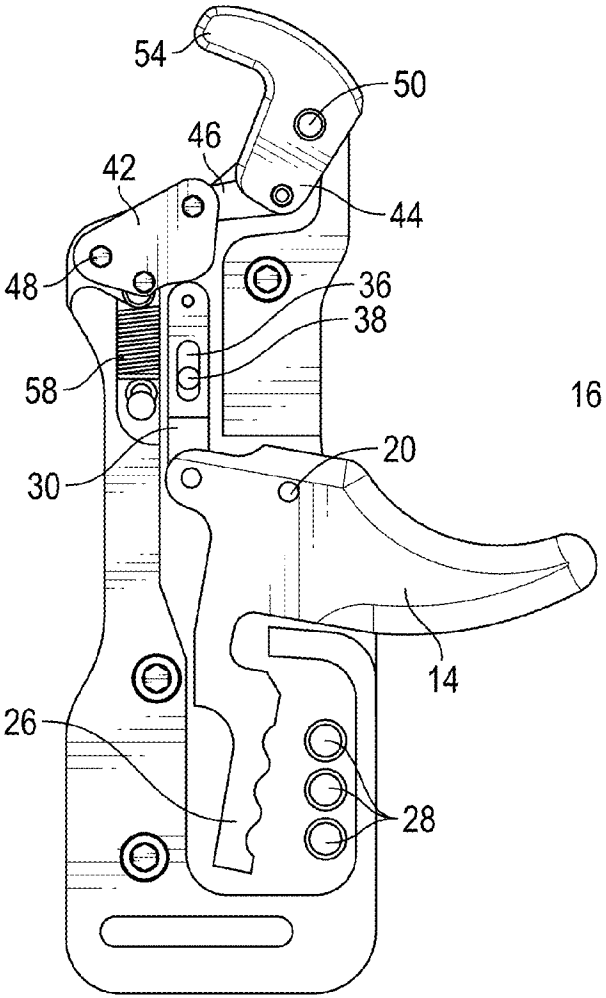
FIG. 3 is a cut-away view of the magnetic trigger assembly in a second position.

With reference to FIG. 3, the rotation of trigger member 14 into the second position pushes second trigger member 30 toward first sear element 42. Distal contact surface 40 of second trigger member 30 pushes sear surface 56 of first sear element 42, thereby rotating first sear element 42 about pivot point 48 against the force of spring 58. The rotation of first sear element 42 pulls sear arm 46 and proximal end 52 of second sear element 44 in a direction toward first sear element 42, such that second sear element 44 is rotated about pivot point 50 into the second position shown in FIG. 3 to release any bow string engaged by hook portion 16 (i.e., to fire the weapon).

Figure 4:
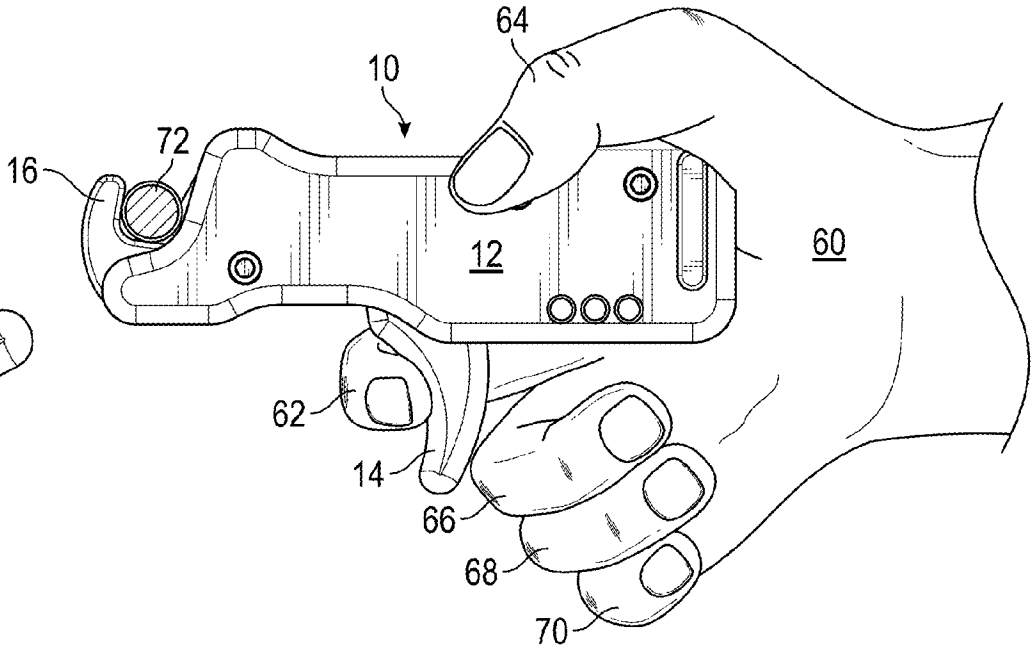
FIG. 4 is a side view of the magnetic trigger assembly held in a user's hand to engage a bow string.

FIG. 4 illustrates trigger assembly 10 held in a user's hand 60. In this embodiment, the user's hand 60 may engage trigger assembly 10 by engaging trigger member 14 with index finger 62 with thumb 64 resting on housing 12. Middle finger 66, ring finger 68, and pinky finger 70 may all be suspended separate from trigger member 14. With trigger assembly 10 in the first position, hook portion 16 of second sear element 44 may be used to engage bow string 72. In one embodiment, bow string 72 is a secondary string secured to the bow string of a vertical bow near the point at which an arrow engages the bow string. The user may pull bow string 72 to place the bow in a cocked position. Thereafter, actuating trigger member 14 with index finger 62 releases bow string 72 from hook portion 16 to fire the bow.

In the embodiment shown in FIGS. 1-4, the threshold force value required to separate magnetic trigger portion 26 from stationary magnets 28 is greater than the force required to move second sear element 44 into the second position (i.e., the force required to move second sear element 44 into the second position if trigger assembly 10 included no magnets). In this embodiment, the force required to move second sear element 44 into the second position may be defined by the configuration of first sear element 42, sear arm 46, and second sear element 44, along with the strength of spring 58. In this way, second sear element 44 is moved into the second position immediately (or nearly immediately) when trigger member 14 pivots into the second position. In the embodiment shown in FIGS. 1-4, stationary magnets 28 are positioned at least ½ inch from pivot point 20 of trigger member 14. In some embodiments of trigger assembly 10, stationary magnets 28 are positioned at least ¾ inches from pivot point 20 of trigger member 14.

Figure 5:
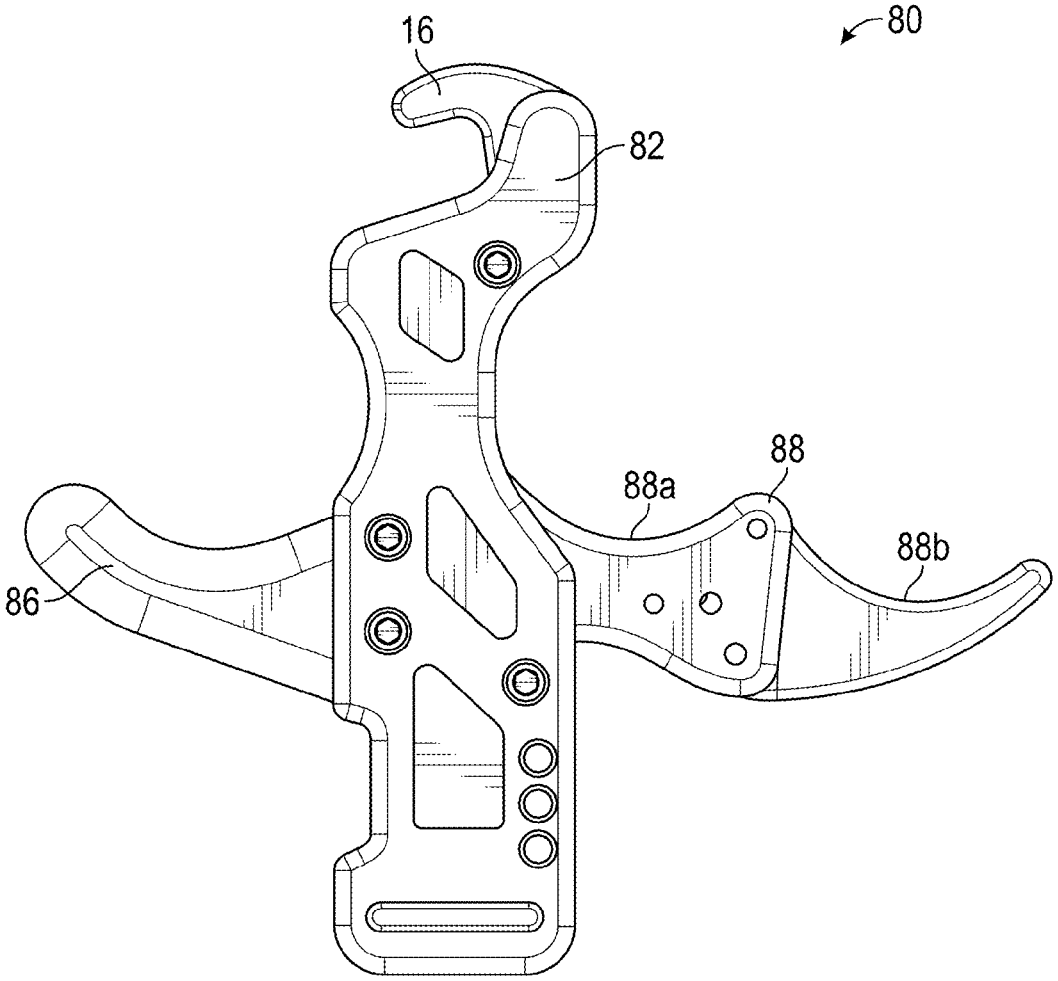
FIG. 5 is a side view of an alternate embodiment of the magnetic trigger assembly.

Referring now to FIG. 5, trigger assembly 80 includes housing 82 with a portion of trigger member 84 and hook portion 16 each extending beyond housing 12. Trigger assembly 80 may also include stationary finger rest 86. Trigger member 84 includes actuating surface 88 configured to receive an applied force from a user (e.g., from the user's fingers). In the embodiment illustrated, actuating surface 88 includes two curved surfaces 88*a* and 88*b* for receiving a user's fingers. Except as otherwise described, trigger assembly 80 may include the same components and function in the same manner as described in connection with trigger assembly 10 shown in FIGS. 1-4.

Figure 6:
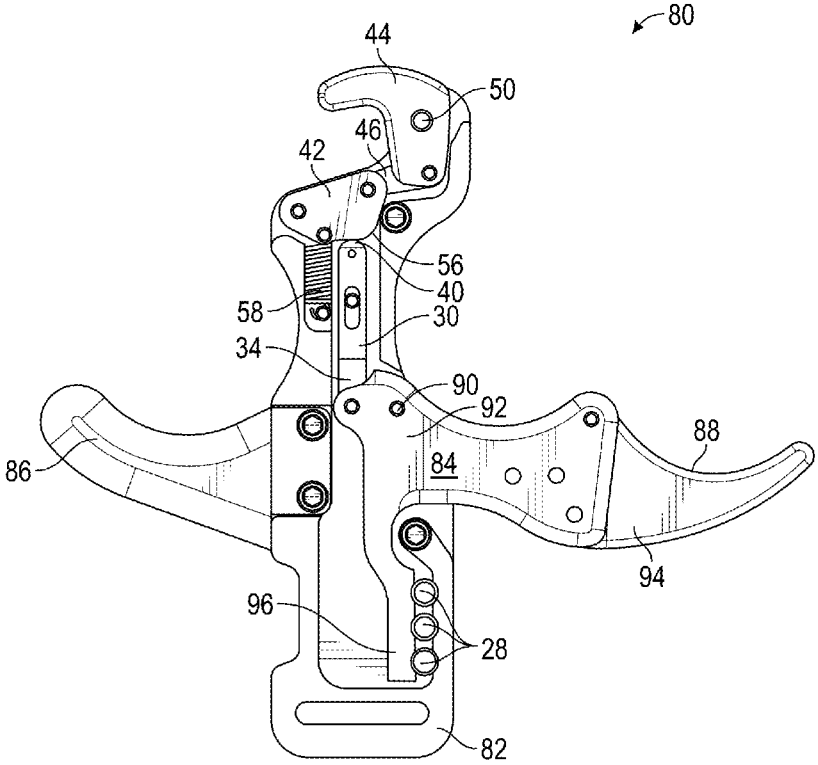
FIG. 6 is a cut-away view of the magnetic trigger assembly shown in FIG. 5 in a first position.

With reference to FIG. 6, trigger member 84 is mounted within housing 82 for pivotal movement about pivot point 90 on base portion 92 of trigger member 84. In one embodiment, pivot point 90 is formed by a trigger aperture in trigger member 84 and a pin disposed through the trigger aperture, with the pin engaging housing 82 to pivotally mount trigger member 84 therein. Trigger member 84 includes actuating portion 94 extending from base portion 92 in a first direction, and magnetic trigger portion 96 extending from base portion 92 in a second direction. Actuating portion 94 includes actuating surface 88. Magnetic trigger portion 96 is adjacent to stationary magnets 28. Trigger member 84 may be operatively connected to second trigger member 30. For example, a pin may be disposed through an aperture in proximal end 34 of second trigger member 30 and an aperture in base portion 92 of trigger member 84.

Trigger member 84 is configured to provide an angle between the first direction and the second direction of at least 35 degrees (i.e., the first and second directions are separated by at least 35 degrees). In some embodiments, the angle between the first direction and the second direction is between 35 and 180 degrees, or any subrange therein.

In a first position illustrated in FIG. 6, magnetic trigger portion 96 is in contact with magnets 28, and distal contact surface 40 of second trigger member 30 engages sear surface 56 of first sear element 42. Alternatively, magnetic trigger portion 96 may indirectly engage magnets 28, such as through a coating or other barrier allowing the sufficient magnetic attraction between magnets 28 and magnetic trigger portion 96 to allow trigger assembly 80 to function as described herein. When a force applied to actuating surface 88 of trigger member 84 reaches the threshold value required to overcome the magnetic attraction (between magnetic trigger portion 96 and magnets 28) and the tension of spring 58, magnetic trigger portion 96 is released from magnets 28, thereby allowing trigger member 84 to rotate about pivot point 90 into the second position illustrated in FIG. 7.

Figure 7:
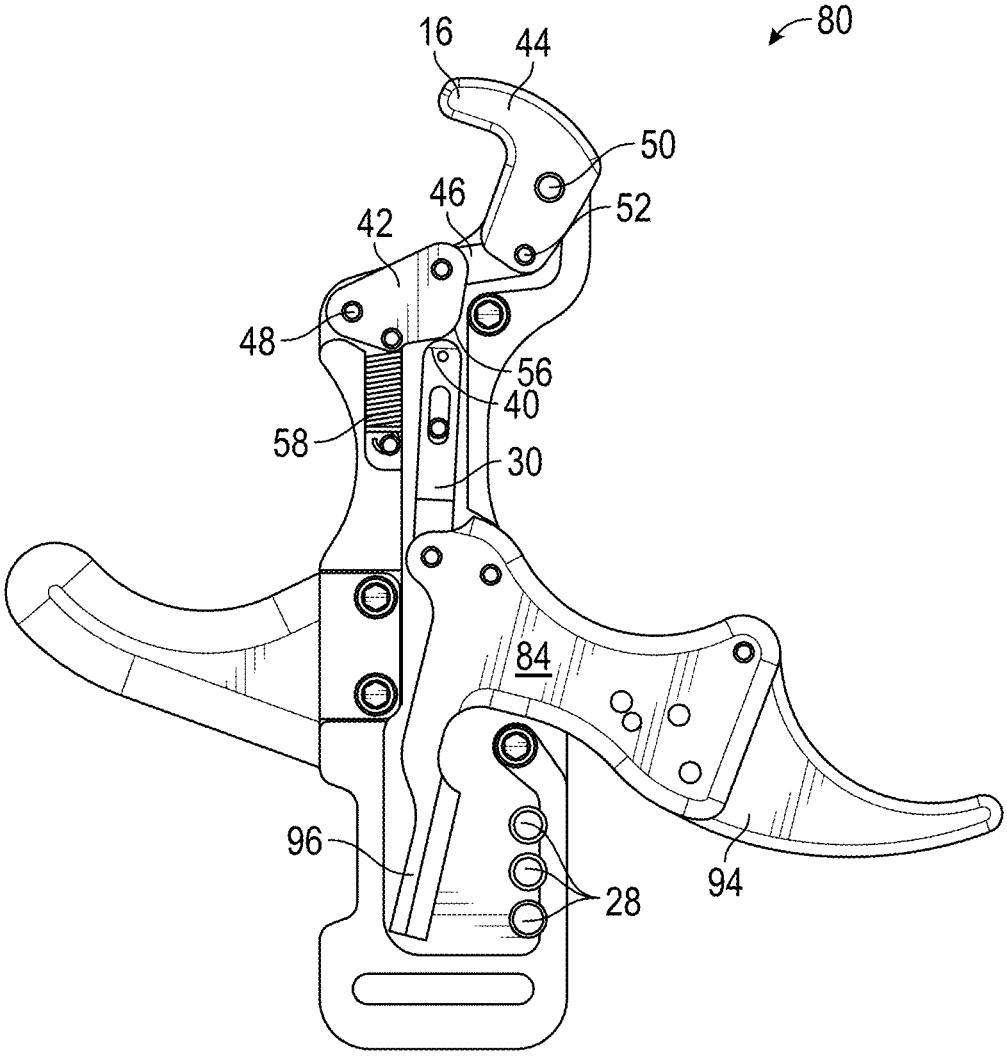
FIG. 7 is a cut-away view of the magnetic trigger assembly shown in FIG. 5 in a second position.

With reference to FIG. 7, the rotation of trigger member 84 into the second position pushes second trigger member 30 toward first sear element 42. Distal contact surface 40 of second trigger member 30 pushes sear surface 56 of first sear element 42, thereby rotating first sear element 42 about pivot point 48 against the force of spring 58. The rotation of first sear element 42 pulls sear arm 46 and proximal end 52 of second sear element 44 in a direction toward first sear element 42, such that second sear element 44 is rotated about pivot point 50 into the second position shown in FIG. 7 to release any bow string engaged by hook portion 16 (i.e., to fire the weapon).

Figure 8:
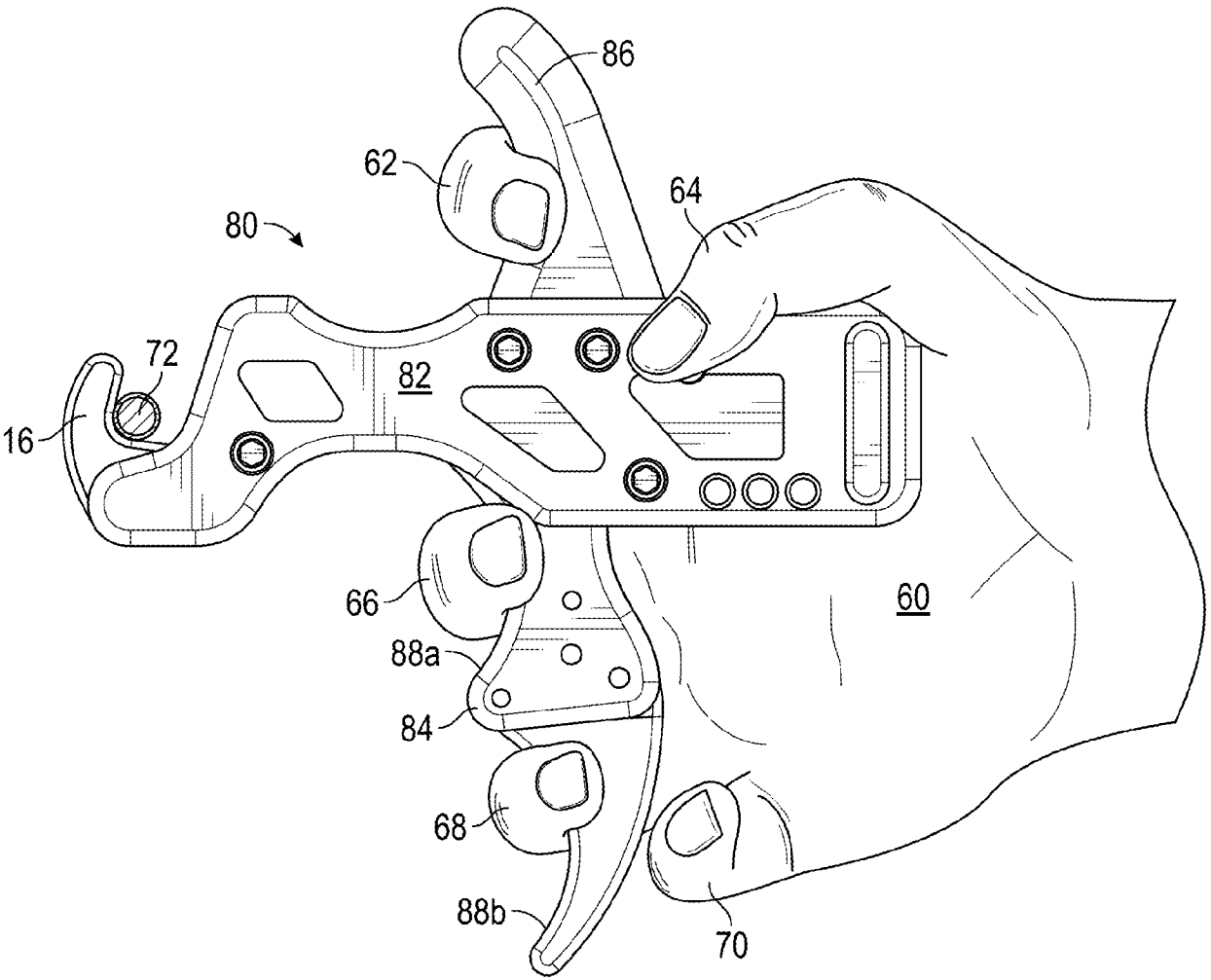
FIG. 8 is a side view of the magnetic trigger assembly shown in FIG. 5 held in a user's hand to engage a bow string.

FIG. 8 illustrates trigger assembly 80 held in a user's hand 60. In this embodiment, the user's hand 60 may engage trigger assembly 80 by engaging stationary finger rest 86 with index finger 62, and engaging actuating surface 88 of trigger member 84 with middle finger 66 and ring finger 68. In the embodiment illustrated, the user's middle finger 66 engages curved surface 88*a* and the user's ring finger 68 engages curved surface 88*b*. Thumb 64 may rest on housing 82. The user's pinky finger 70 may be suspended separate from trigger member 84. With trigger assembly 80 in the first position, hook portion 16 of second sear element 44 may be used to engage bow string 72. In one embodiment, bow string 72 is a secondary string secured to the bow string of a vertical bow near the point at which an arrow engages the bow string. The user may pull bow string 72 to place the bow in a cocked position. Thereafter, actuating trigger member 84 with middle finger 66 and ring finger 68 releases bow string 72 from hook portion 16 to fire the bow.

In the embodiment shown in FIGS. 5-8, the threshold force value required to separate magnetic trigger portion 96 from stationary magnets 28 is greater than the force required to move second sear element 44 into the second position (i.e., the force required to move second sear element 44 into the second position if trigger assembly 80 included no magnets). In this embodiment, the force required to move second sear element 44 into the second position may be defined by the configuration of first sear element 42, sear arm 46, and second sear element 44, along with the strength of spring 58. In this way, second sear element 44 is moved into the second position immediately (or nearly immediately) when trigger member 84 pivots into the second position. In the embodiment shown in FIGS. 5-8, stationary magnets 28 are positioned at least ½ inch from pivot point 90 of trigger member 84. In some embodiments of trigger assembly 80, stationary magnets 28 are positioned at least ¾ inches from pivot point 90 of trigger member 84.

Figure 9:
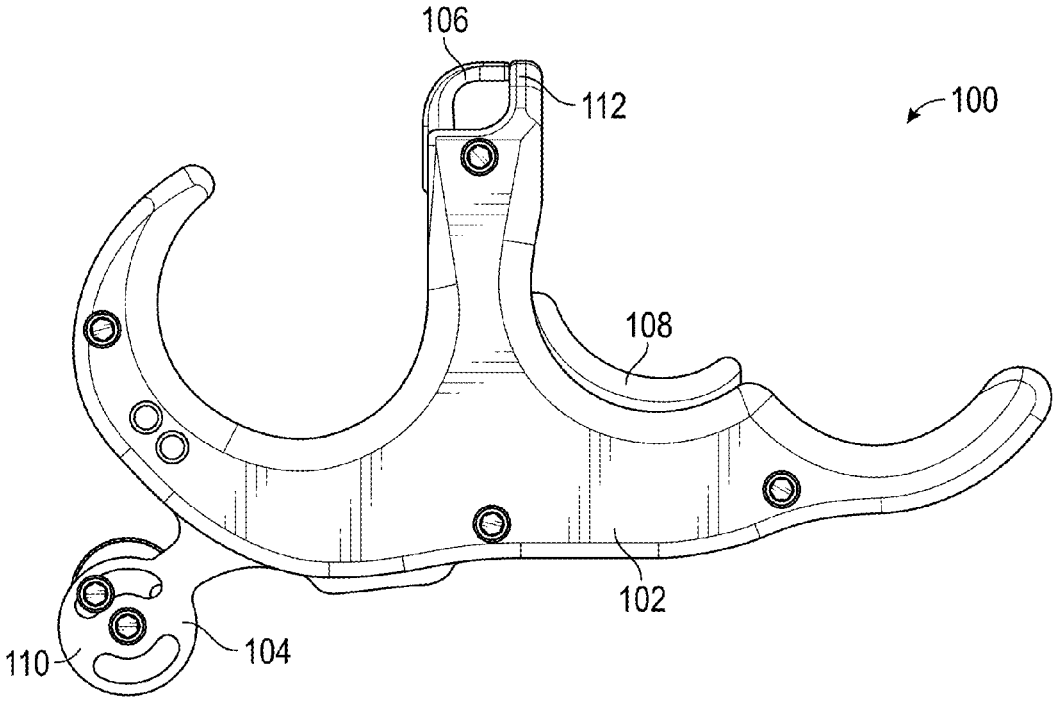
FIG. 9 is a side view of another alternative embodiment of the magnetic trigger assembly.

FIG. 9 illustrates trigger assembly 100, which includes housing 102 with a portion of trigger member 104, hook portion 106, and safety trigger 108 each extending beyond housing 102. Trigger member 104 includes actuating portion 110 configured to receive an applied force from a user (e.g., from a user's thumb). Hook portion 106 is configured to retain a bow string in a first position shown in FIG. 9. In the illustrated embodiment, hook portion 106 may abut upstanding portion 112 of housing 102 in the first position. Actuation of trigger member 104 places hook portion 16 in a second position, which releases the bow string.

Figure 10:
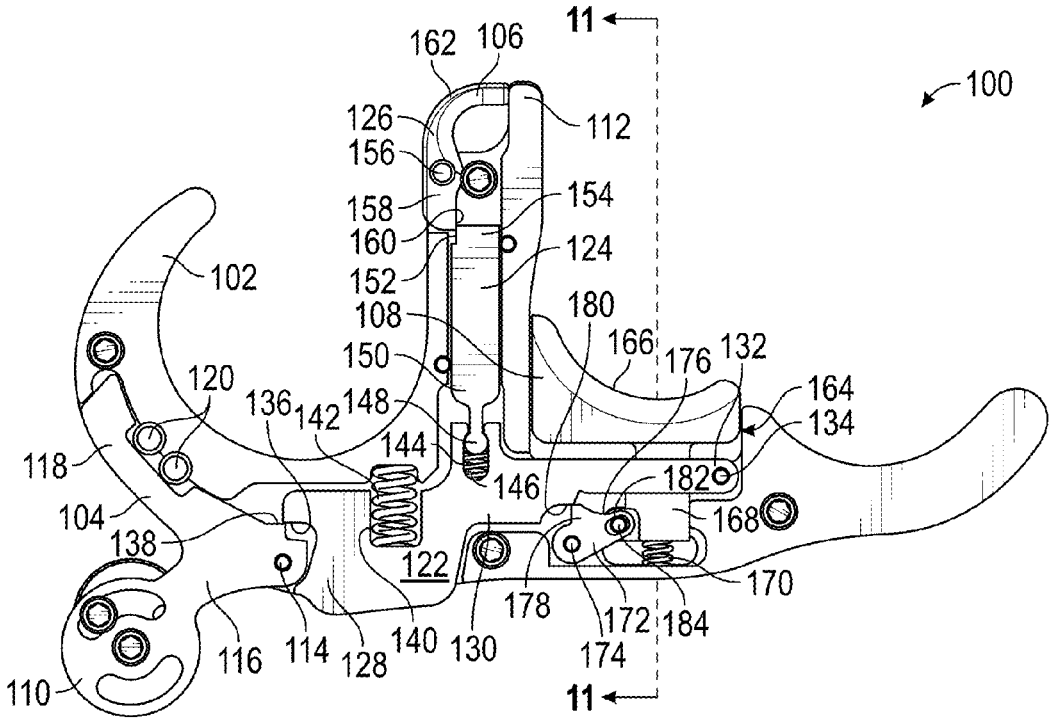
FIG. 10 is a cut-away view of the magnetic trigger assembly of FIG. 9 in a first position.

Referring now to FIG. 10, trigger member 104 is pivotally mounted to housing 102 for pivotal movement about pivot point 114 on base portion 116 of trigger member 104. In one embodiment, pivot point 114 is formed by a trigger aperture in trigger member 104 and a pin disposed through the trigger aperture, with the pin engaging housing 102 to pivotally mount trigger member 104 thereto. Actuating portion 110 of trigger member 104 extends from base portion 116 in a first direction, and magnetic trigger portion 118 of trigger member 104 extends from base portion 116 in a second direction. Trigger assembly 100 further includes one or more stationary magnets 120 affixed within housing 102. Magnetic trigger portion 118 is adjacent to magnets 120. In the first position shown in FIG. 10, magnetic trigger portion 118 engages magnets 120. Alternatively, magnetic trigger portion 118 may indirectly engage magnets 120, such as through a coating or other barrier allowing the sufficient magnetic attraction between magnets 120 and magnetic trigger portion 118 to allow trigger assembly 100 to function as described herein.

Trigger member 104 is configured to provide an angle between the first direction and the second direction of at least 35 degrees (i.e., the first and second directions are separated by at least 35 degrees). In some embodiments, the angle between the first direction and the second direction is between 35 and 180 degrees, or any subrange therein.

In the embodiment illustrated in FIG. 10, trigger assembly 100 further includes first sear element 122, sear arm 124, and second sear element 126. First sear element 122 is formed of a generally elongated member including trigger portion 128, central portion 130, and safety portion 132. First sear element 122 is mounted to housing 102 for pivotal movement about pivot point 134 on safety portion 132 of first sear element 122. In one embodiment, pivot point 134 is formed by an aperture in safety portion 132 of first sear element 122 and a pin disposed through the aperture, with the pin engaging housing 102 to pivotally mount first sear element 122 thereto.

Trigger portion 128 of first sear element 122 is positioned adjacent to trigger member 104. Trigger portion 128 of first sear element 122 includes first sear surface 136 that engages trigger surface 138 of base portion 116 of trigger member 104 in the first position shown in FIG. 10. Trigger portion 128 of first sear element 122 also includes receptacle 140 configured to receive spring 142. Spring 142 may bias first sear element 122 toward a second position (shown in FIG. 13). Central portion 130 of first sear element 122 includes receptacle 144 configured to receive spring 146.

Referring still to FIG. 10, sear arm 124 may be disposed partially or completely within housing 102 between first sear element 122 and second sear element 126. Sear arm 124 may include key portion 148 on first end 150 and distal contact surface 152 on second end 154. Key portion 148 may be configured to engage receptacle 144 of first sear element 122. In one embodiment, receptacle 144 includes a restricted diameter opening, and key portion 148 of sear arm 124 is reciprocally shaped to the restricted diameter opening. Spring 146 may be disposed within receptacle 144 such that spring 146 biases key portion 148 of sear arm 124 when key portion 148 is disposed in receptacle 144. In one embodiment, spring 146 biases key portion 148 in a direction away from first sear element 122.

Second sear element 126 may be affixed to housing 102 for pivotal movement about pivot point 156. Second sear element 126 includes proximal portion 158 having second sear surface 160, and distal portion 162 having hook portion 106. Pivot point 156 is positioned between proximal portion 158 and distal portion 162. In the first position shown in FIG. 10, second sear surface 160 engages distal contact surface 152 of sear arm 124. Also in the first position, distal portion 162 of second sear element 126 abuts upstanding portion 112 of housing 102 to retain a bow string therein.

Figure 11:
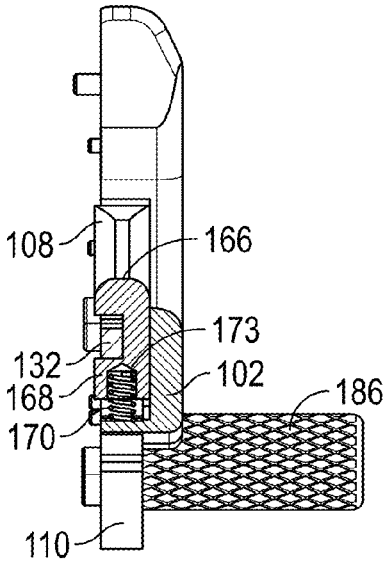
FIG. 11 is a sectional view of the magnetic trigger assembly of FIG. 9 taken along line A-A in FIG. 10.

Referring still to FIG. 10, trigger assembly 100 further includes safety assembly 164 slidingly connected to housing 102 and positioned adjacent to safety portion 132 of first sear element 122. Safety assembly 164 may include safety trigger 108 having safety surface 166 and spring portion 168. Safety surface 166 may be engaged by a user (e.g., by a user's finger). Safety assembly 164 may also include spring 170 positioned within housing 102, with spring 170 biasing spring portion 168 of safety trigger 108 toward the first position shown in FIG. 10. As illustrated in FIG. 11, one embodiment of safety trigger 108 includes spring receptacle 173 in spring portion 168. Spring receptacle 173 may be configured to receive spring 170.

With reference again to FIG. 10, safety assembly 164 may further include safety lock 172, which is mounted to housing 102 for pivotal movement about pivot point 174. In one embodiment, pivot point 174 is formed by an aperture in safety lock 172 and a pin disposed through the aperture, with the pin engaging housing 102 to pivotally mount safety lock 172 thereto. Safety lock 172 may further include first end 176 that engages spring portion 168 of safety trigger 108 and lock portion 178 that engages first sear element 122 in the first position shown in FIG. 10. In one embodiment, lock portion 178 engages safety lock surface 180 of first sear element 122 in the first position. Safety lock 172 may further include elongated aperture 182 configured to receive pin 184, which is secured to safety trigger 108. In the first position, lock portion 178 of safety lock 172 prevents first sear element 122 from rotating about pivot point 134.

As shown in FIG. 11, actuating portion 110 of trigger member 104 may include elongated member 186 to accommodate a user's thumb.

Figure 12:
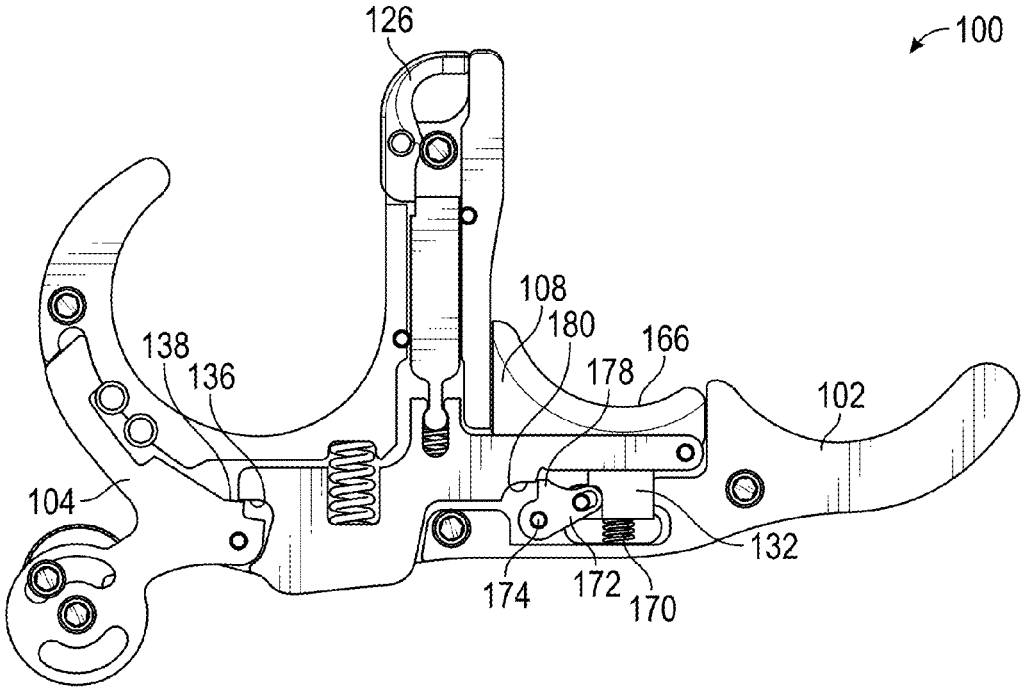
FIG. 12 is a cut-away view of the magnetic trigger assembly of FIG. 9 in a safety-released position.

Referring now to FIG. 12, when a user applies a force (e.g., with the user's finger) greater than a threshold value to safety surface 166 of safety trigger 108, safety trigger 108 may slide into housing 102. This movement compresses spring 170 and forces safety lock 172 to pivot about pivot point 174 to a safety-released position shown in FIG. 12. In the safety-released position, lock portion 178 disengages safety lock surface 180 of first sear element 122. However, first sear element 122 is prevented from rotating in the safety-released position only due to trigger surface 138 of trigger member 104 engaging first sear surface 136 of first sear element 122. In other words, in the safety-released position, actuation of only trigger member 104 moves the second sear element 126 into a second position to release a bow string secured by the second sear element 126 (as described in more detail below). If the user releases the force from safety surface 166, safety trigger 108 returns to the first position shown in FIG. 10.

Figure 13:
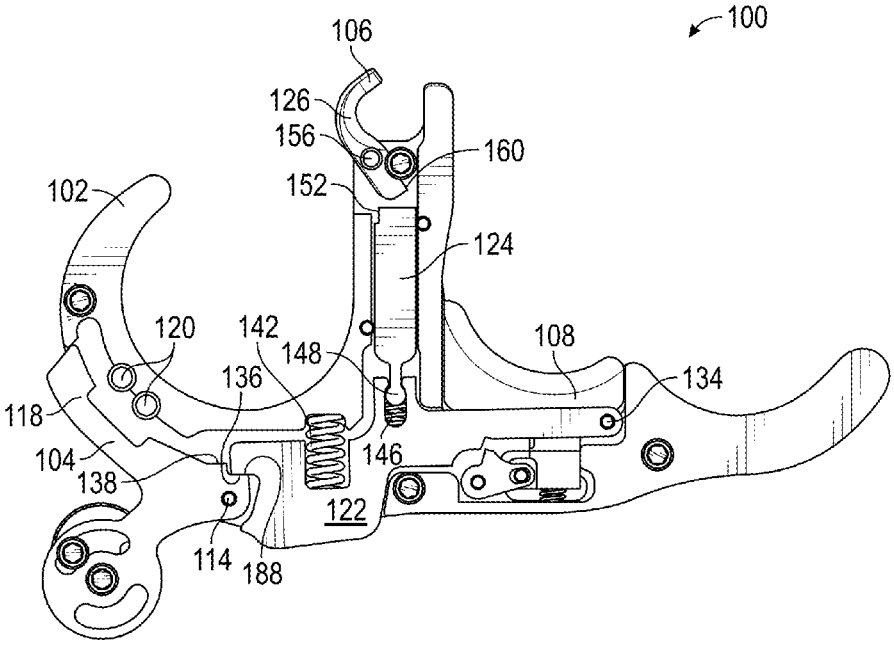
FIG. 13 is a cut-away view of the magnetic trigger assembly of FIG. 9 in a fully released position.

With reference to FIG. 13, if a user then applies a force to actuating portion 110 of trigger member 104 that exceeds a threshold value, trigger member 104 rotates about pivot point 114 separating magnetic trigger portion 118 from stationary magnets 120 to place trigger assembly 100 into the second position shown in FIG. 13. When trigger member 104 rotates into the second position, trigger surface 138 of trigger member 104 releases first sear surface 136 of first sear element 122. Spring 142 then forces first sear element 122 to rotate counterclockwise (in this view) about pivot point 134. In one embodiment, first sear surface 136 engages secondary trigger surface 188 of trigger member 104 in the second position as shown. The rotation of first sear element 122 pulls key portion 148 of sear arm 124 in a direction away from second sear element 126, thereby separating distal contact surface 152 of sear arm 124 from second sear surface 160 of second sear element 126. Second sear element 126 is then free to rotate about pivot point 156 in a counterclockwise direction (in this view) to release any bow string that was held by hook portion 106.

Figure 14:
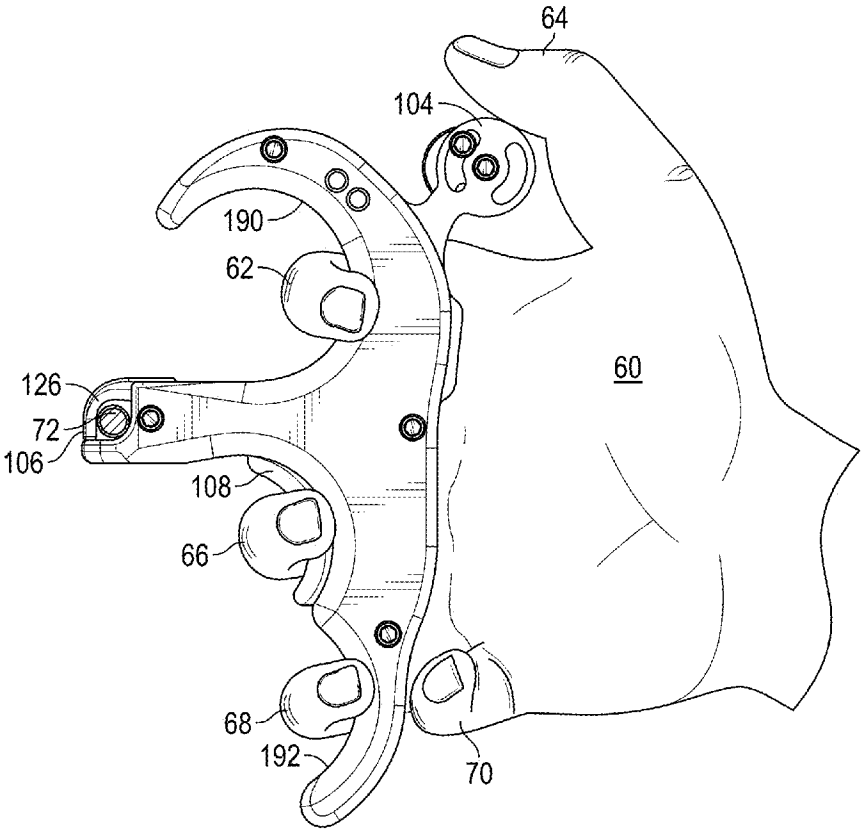
FIG. 14 is a side view of the magnetic trigger assembly of FIG. 9 held in a user's hand to engage a bow string.

FIG. 14 illustrates trigger assembly 100 held in a user's hand 60. In this embodiment, the user's thumb 64 may engage trigger member 104 and the user's middle finger 66 may engage safety trigger 108. The user's index finger 62 may rest on first surface 190 of housing 102, and the user's ring finger 68 may rest on second surface 192 of housing 102.

Trigger member 104 may only be activated while trigger assembly 100 is in the safety-released position shown in FIG. 12. In this way, safety assembly 164 reduces the chance of a user accidentally releasing the bow string and firing the bow.

In the embodiment shown in FIGS. 9-14, the threshold force value required to separate magnetic trigger portion 118 from stationary magnets 120 is greater than the force required to move second sear element 126 into the second position (i.e., the force required to move second sear element 44 into the second position if trigger assembly 100 included no magnets). In this embodiment, the force required to move second sear element 126 into the second position may be defined by the strength of spring 142. In this way, second sear element 126 is moved into the second position immediately (or nearly immediately) when trigger member 104 pivots into the second position. In the embodiment shown in FIGS. 9-14, stationary magnets 120 are positioned at least ½ inch from pivot point 114 of trigger member 104. In some embodiments of trigger assembly 100, stationary magnets 120 are positioned at least % inches from pivot point 114 of trigger member 104.

The magnetic trigger portion of each trigger member may be formed of any magnetic material, such as steel or a magnetic stainless steel. The stationary magnet(s) mounted to the housing may be formed of any magnet that is rust-resistant, such as rare earth magnets. When more than one magnet is included in the trigger assembly, the stationary magnets may be selected such that the force required to separate the magnetic trigger portion from all stationary magnets is between 0.5 lb. and 5 lb., or any subrange therein. For example, each stationary magnet may be rated for 1.5 lb. In other words, the threshold force value for actuating the trigger member in all embodiments of the trigger assembly is between 0.5 lb. and 5 lb., or any subrange therein.

In all embodiments, the threshold force value required to separate the magnetic trigger portion from the stationary magnets is greater than the force required to move the second sear element into the second position (to release a bow string). In this way, the second sear element is moved into the second position immediately (or nearly immediately) when the magnetic trigger portion is separated from the stationary magnets (i.e., when the trigger member pivots into the second position).

Each assembly described herein may include any combination of the described components, features, and/or functions of each of the individual assembly embodiments. Each method described herein may include any combination of the described steps in any order, including the absence of certain described steps and combinations of steps used in separate embodiments. Any range of numeric values disclosed herein shall be construed to include any subrange therein.

While preferred embodiments of the present invention have been described, it is to be understood that the embodiments are illustrative only and that the scope of the invention is to be defined solely by the appended claims when accorded a full range of equivalents, many variations and modifications naturally occurring to those skilled in the art from a review hereof.

I claim:

1. A trigger assembly comprising:

one or more stationary magnets;

a trigger member pivotable relative to the stationary magnets, wherein the trigger member includes a base portion with a trigger pivot point about which the trigger member pivots, an actuating portion extending from the base portion in a first direction, and a magnetic trigger portion extending from the base portion in a second direction, wherein the magnetic trigger portion operatively engages the one or more stationary magnets in a first position;

a first sear element pivotable about a first sear pivot point, wherein the base portion of the trigger member operatively engages the first sear element;

a spring operatively biasing the first sear element;

a sear arm operatively connected to the first sear element;

a second sear element including a proximal portion, a distal portion, and a second sear pivot point between the proximal portion and the distal portion, wherein the proximal portion operatively engages the sear arm, and wherein the second sear element is pivotable about the second sear pivot point to retain a bow string in the first position;

wherein in a second position the magnetic trigger portion is spaced apart from the one or more stationary magnets and the distal portion of the second sear element releases the bow string.

2. The trigger assembly of claim 1, wherein the distal portion of the second sear element includes a hook shape.

3. The trigger assembly of claim 2, further comprising a housing, wherein the trigger member, the first sear element, and the second sear element are each pivotally mounted to the housing; and wherein the actuating portion of the trigger member and the second sear element each extends beyond the housing.

4. The trigger assembly of claim 3, wherein the spring biases the first sear element toward the first position.

5. The trigger assembly of claim 4, further comprising a second trigger member connected to the base portion of the trigger member and engaging the first sear element.

6. The trigger assembly of claim 5, further including an alignment pen disposed through a longitudinal groove in the second trigger member.

7. The trigger assembly of claim 6, further comprising a stationary finger rest extending from the housing opposite the actuating portion of the trigger member.

8. The trigger assembly of claim 3, wherein the spring biases the first sear element toward the second position.

9. The trigger assembly of claim 8, wherein in the first position a distal end of the sear arm engages the proximal portion of the second sear element to maintain the second sear element in the first position; and wherein in the second position the distal end of the sear arm disengages from the proximal portion of the second sear element to allow the second sear element to rotate about the second sear pivot point into the second position releasing the bow string.

10. The trigger assembly of claim 9, wherein a proximal end of the sear arm includes a key portion, wherein the first sear element further includes a receptacle and a receptacle spring disposed within the receptacle, wherein the key portion of the sear arm is disposed within the receptacle and is biased by the receptacle spring.

11. The trigger assembly of claim 10, further comprising a safety assembly operatively engaging the first sear element, wherein in the first position the safety assembly engages the first sear element to prevent the first sear element from rotating about the first sear pivot point into the second position, and wherein in a safety-released position the safety assembly disengages the first sear element to allow the first sear element to rotate about the first sear pivot point if the trigger member disengages the first sear element.

12. The trigger assembly of claim 11, wherein the safety assembly comprises:

a safety trigger slidingly mounted to the housing, the safety trigger including a safety surface and a spring portion;

a spring engaging the spring portion to bias the safety trigger toward the first position;

a safety lock pivotable about a safety pivot point, wherein a first end of the safety lock engages the spring portion of the safety trigger, and wherein a lock portion of the safety lock engages the first sear element;

wherein in the first position the lock portion of the safety lock prevents the first sear element from rotating about the first sear pivot point, and wherein actuation of the safety trigger rotates the safety lock about the safety pivot point to disengage the lock portion from the first sear element in the safety-released position.

13. The trigger assembly of claim 3, wherein the one or more stationary magnets are separated from the trigger pivot point by a distance of at least ½ inch.

14. The trigger assembly of claim 3, wherein the one or more stationary magnets are separated from the trigger pivot point by a distance of at least ¾ inch.

15. A method of releasing a bow string to fire a weapon comprising the steps of:

a) providing a trigger assembly comprising: one or more stationary magnets; a trigger member pivotable relative to the stationary magnets, wherein the trigger member includes a base portion with a trigger pivot point about which the trigger member pivots, an actuating portion extending from the base portion in a first direction, and a magnetic trigger portion extending from the base portion in a second direction, wherein the magnetic trigger portion operatively engages the one or more stationary magnets in a first position; a first sear element pivotable about a first sear pivot point, wherein the base portion of the trigger member operatively engages the first sear element; a spring operatively biasing the first sear element; a sear arm operatively connected to the first sear element; a second sear element including a proximal portion, a distal portion, and a second sear pivot point between the proximal portion and the distal portion, wherein the proximal portion operatively engages the sear arm, and wherein the second sear element is pivotable about the second sear pivot point to retain a bow string in the first position; wherein in a second position the magnetic trigger portion is spaced apart from the one or more stationary magnets and the distal portion of the second sear element releases the bow string;

b) engaging a bow string of a weapon with the distal portion of the second sear element with the trigger assembly in the first position;

c) cocking the weapon with the bow string secured with the second sear element of the trigger assembly;

d) applying a force to the actuating portion of the trigger member to rotate the trigger member into the second position and rotate the second sear element into the second position, thereby releasing the bow string; wherein the trigger member and the second sear element do not rotate into the second position unless and until the force applied to the actuating portion of the trigger member meets or exceeds a threshold force value.

16. The method of claim 15, wherein the threshold force value is a force required to overcome a magnetic attraction between the magnetic trigger portion and the one or more stationary magnets.

17. The method of claim 15, wherein the threshold force value is greater than a force required to move the second sear element into the second position.

18. The method of claim 15, wherein the trigger assembly further comprises a second trigger member connected to the base portion of the trigger member and engaging the first sear element, and wherein in step (d) the trigger member rotates about the trigger pivot point to force the second trigger member to rotate the first sear element about the first sear pivot point, thereby rotating the second sear element to release the bow string.

19. The method of claim 15, wherein the trigger assembly further comprises a safety assembly operatively engaging the first sear element; and wherein in step (b) the safety assembly engages the first sear element in the first position to prevent the first sear element from rotating about the first sear pivot point.

20. The method of claim 19, wherein the safety assembly includes a safety trigger and a safety lock, wherein the safety lock engages the first sear element in the first position, and wherein the method further comprises:

c1) actuating the safety trigger to release the safety lock from the first sear element.

* * * * *